US006013148A

United States Patent [19]

Bluemle

[11] Patent Number: 6,013,148

[45] Date of Patent: Jan. 11, 2000

[54] APPARATUS FOR JOINING ENDS OF MATERIAL WEBS TO EACH OTHER

[75] Inventor: Martin Bluemle, Horhausen, Germany

[73] Assignee: Winkler & Duennebier Maschinenfabrik und Eisengiesserei KG, Neuwied, Germany

[21] Appl. No.: 08/123,587

[22] Filed: Sep. 17, 1993

Related U.S. Application Data

[63] Continuation of application No. 07/705,034, May 20, 1991.

[30] Foreign Application Priority Data

May 23, 1990 [DE] Germany ..... 40 16 578

[51] Int. Cl.[7] ..... B65H 21/00; B65H 69/06

[52] U.S. Cl. ..... 156/159; 156/504; 156/505; 156/507; 242/552; 242/553; 242/554.2

[58] Field of Search ..... 156/157, 159, 156/502, 504, 505, 507; 242/58.1, 58.2, 58.3, 58.4, 58.5, 552, 553, 554.2, 556.1, 555.1

[56] References Cited

U.S. PATENT DOCUMENTS

| | | | |
|---|---|---|---|
| Re. 29,365 | 8/1977 | Butler, Jr. | 242/58.4 X |
| 3,995,791 | 12/1976 | Schoppee | 242/58.1 |
| 4,331,301 | 5/1982 | Martinez | 242/56 R |
| 4,455,190 | 6/1984 | Bianchetto et al. | 156/505 X |
| 4,519,858 | 5/1985 | Martin | 156/157 X |
| 4,722,489 | 2/1988 | Wommer | 156/502 X |
| 4,984,750 | 1/1991 | Shigeta et al. | 156/504 X |
| 5,064,488 | 11/1991 | Dickey | 156/504 X |

FOREIGN PATENT DOCUMENTS 3411398 10/1998 Germany .

*Primary Examiner*—Mark A. Osele

*Attorney, Agent, or Firm*—W. F. Fasse; W. G. Fasse

[57] ABSTRACT

The ends of material webs or tapes are joined to each other in an apparatus in which two holding and press-on heads are tiltable about fixed journal axes away from two fixed guide rollers for the webs so that a slide carriage for the heads and for the fixed guide rollers is avoided. The holding and press-on heads are mounted outside of the spacing between the guide rollers, but close to these guide rollers, but with a defined spacing from these guide rollers.

20 Claims, 6 Drawing Sheets

APPARATUS FOR JOINING ENDS OF MATERIAL WEBS TO EACH OTHER

This application is a continuation of application Ser. No. 07/705,034, filed on May 20, 1991.

FIELD OF THE INVENTION

The invention relates to an apparatus for joining a trailing end of one material web to the leading end of another material web, for example, by means of an adhesive and/or by means of an adhesive tape.

BACKGROUND INFORMATION

The two webs come from different supply reels, whereby guide rollers lead the respective web to holding and press-on heads which are spaced from each other, but can move toward each other. These holding heads grip, hold, and press the respective web ends to form a splice. The heads are equipped with suction holes and additionally are tiltable for the application of an adhesive tape or strip. Drives are provided for pressing the holding and press-on heads against each other. A severing knife is so arranged that it is effective in a plane between the guide rollers and the holding and press-on heads.

German Patent Publication (DE) 3,411,398 (Bianchetto et al.) corresponding to U.S. Ser. No. 495,301, filed in the U.S.A. on Apr. 20, 1983, now U.S. Pat. No. 4,455,190 (Bianchetto et al.), discloses such an apparatus for the joining of material webs. When one supply reel becomes empty, the trailing end of the respective web must be connected to the leading end of the web on a replacement reel. The known apparatus comprises an upper slide and a lower slide equipped with guide rollers for the material webs and with hold-down rods carrying holding heads and press-on heads. The holding heads and the press-on heads cooperate for fixing the respective web beginning or web end by means of suction air. These holding and press-on heads are movable toward each other. Additionally, upon displacement of the above mentioned slides, in the press-down direction, the heads are tiltable in such a manner that the web end or web beginning secured to the respective head, can be easily coated by an operator because the web beginning and the web end is easily accessible for the application of an adhesive or of an adhesive strip.

The apparatus according to said German Patent Publication 3,411,398 is easy to operate. However, the known apparatus comprises numerous components cooperating in a complicated manner so that the structural effort and expense is quite substantial with the added disadvantage that the entire system is trouble-prone. For example, the severing knife is arranged in a knife carriage or slide into which the web end must be led before the web end can be severed. During the severing operation, the web end extends at a slant to the severing knife or to the knife stroke. A counter tool cooperating with the severing knife is constructed as brushes which are supposed to assure a clean severing cut having regard to the acute cutting angle. However, such a clean cut is not always assured. Further, the above mentioned substantial structural effort and expense is due to the following features: the arrangement of the holding and press-on heads on respective slides, the required mounting of these heads so that they are additionally tiltable toward each other on the slides, the special arrangement and position of the severing knife with its respective drive in a plane between the two slides, and the additional angular levers and control levers which make the entire system rather trouble-prone,as mentioned.

OBJECTS OF THE INVENTION

In view of the above it is the aim of the invention to achieve the following objects singly or in combination:

- to provide an apparatus of the type described above which remains easily operable, yet reduces the structural effort and expense;
- to reduce the number of components while still achieving an easy operation and maintenance and simultaneously reducing the trouble-prone tendency; and
- to provide a method for the joining of two ends of material webs to each other, which assures a secure, simply made joint in an economical manner.

SUMMARY OF THE INVENTION

The above objects have been achieved according to the invention by the following features. The holding heads and the press-on heads are mounted on journal axes which are in turn mounted with a spacing from the guide rollers and outside the space between the guide rollers. This type of mounting of the holding and press-on heads with the specific position and arrangement of the journal axes of these heads makes it possible to altogether avoid the slides for the mounting of the guide rollers and to also avoid a movement stroke in combination with a tilting motion of the holding and press-on heads. Thus, the number of components and the structural effort and expense have been substantially reduced with the added benefit that the entire system according to the invention is less trouble-prone as compared to conventional systems, while still providing an easy accessibility, an easy operability, and an efficient maintenance.

According to the invention there is further provided a method for the joining of two web ends to each other by the following steps:

(a) tilting a first holding and press-on head out of an operating position into an out of the way position, (b) pulling a leading end of a new web around a guide roller, (c) securing said leading end of a new web to said first holding and press-on head in said out of the way position, (d) applying adhesive means to said leading end, (e) tilting said first holding and press-on head back into said operating position, (f) pressing said leading end against a trailing web end against a trailing web end held in place by a second holding and press-on head, (g) moving said first and second holding and press-on heads into a position for cutting any excess end portion of said trailing web end, (h) cutting said excess end portion of said trailing end, and (i) releasing the now joined web ends from said first and second holding and press-on heads.

Due to the position and arrangement of the journal axis for the journalling mounting of the holding and press-on heads, it is possible according to the invention to avoid slide carriers for the mounting of the guide rollers altogether. Further, the holding and press-on heads according to the invention also do not require a slide carriage since it is sufficient to permit the tilting of the holding head about a fixed journal shaft and to perform a linear movement relative to the fixed journal shaft. These features in combination substantially reduce the number of components and hence the present apparatus is less trouble-prone than similar conventional systems, while still providing the easy access for operation and maintenance work.

BRIEF DESCRIPTION OF THE DRAWINGS

In order that the invention may be clearly understood, it will be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
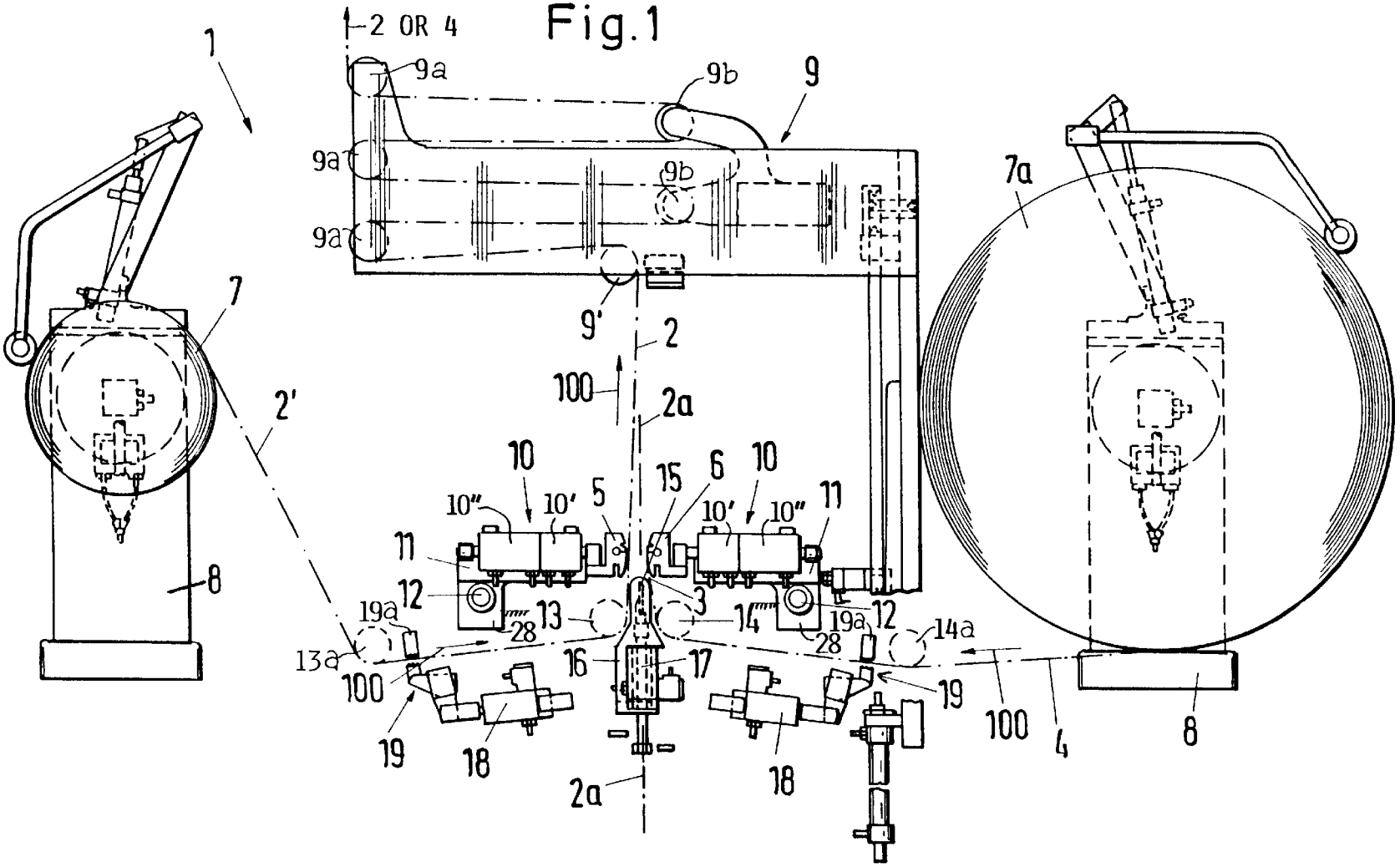
FIG. 1 illustrates a side view of the present apparatus for joining web ends to each other, whereby the viewing direction extends in the direction of the rotational axis of the supply rollers.

Referring first to FIG. 1, the apparatus 1 for joining a material web 2 near its trailing end 2' with a leading end 3 of a second material web 4, comprises two bucks; 8 for rotatably mounting web supply reels 7 and 7*a*. The apparatus further comprises two holding and press-on heads 5 and 6. These heads are arranged symmetrically relative to a central vertical plane 2*a*. During operation the material web 2 or the material web 4 passes through between the heads 5 and 6 and into a web storage station 9 having an inlet guide roller 9'. Each holding and press-on head 5 and 6 is mounted on a carrier 11 and operable by separate piston cylinder devices 10 to be described in more detail below with reference to FIG. 9. The separate piston cylinder devices 10 move the respective head 5, 6 horizontally back and forth independently of each other. Additionally, each of the carriers 11 is journalled to its journal axis 12 extending perpendicularly to the plane of the drawing and in parallel to each other. The journal axes 12 are mounted in mounting brackets or blocks 28 secured to a machine frame only symbolically shown. The horizontal movement of the heads 5 and 6 is relatively short, but sufficient for the facing surface of the heads to pass at least through the central plane 2*a*. A stroke of about 5 mm is sufficient.

Figure 9:
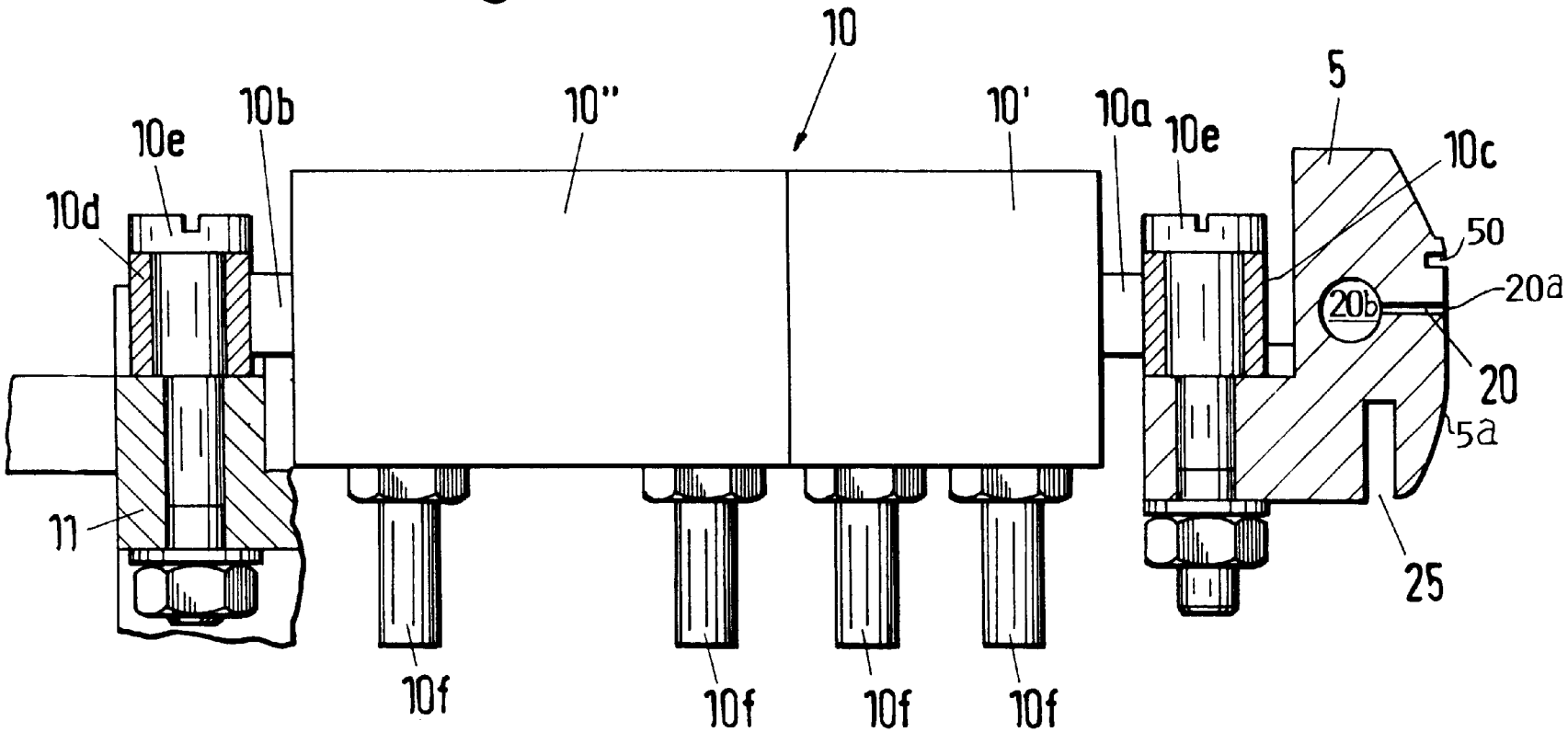
FIG. 9 is an enlarged illustration of the piston cylinder drive means for the holding and press-on heads.

Referring to FIG. 9, each piston cylinder device 10 is constructed identical to the other so that describing one device for the head 5 is sufficient. Each piston cylinder device comprises two cylinders 10' and 10" each having a respective piston rod 10*a*, 10*b*. The two cylinders 10' and 10" including their piston rods 10*a* and 10*b* as such are of conventional construction. The two cylinders are rigidly interconnected as shown.

The piston rod 10*a* of the cylinder 10' carries at its free end 10*c* the holding and press-on head 5 while the piston rod 10*b* of the cylinder 10" is secured with its free end 10*d* to the carrier 11. Screws 10*e* are used in both instances for securing the head 5 to the piston rod 10*a* and the piston rod 10*b* to the carrier 11.

Each head 5, 6 is guided in a parallel guide not shown, since it is conventional. The parallel guides are rigidly secured to the carrier 11 and extend in parallel to the piston rods 10*a* and 10*b*. The head 5 can be exactly displaced horizontally by a respective control of the two cylinders 10' and 10" by means of a valve controlled fluid supply to and from the cylinders through the ports 10*f*. Pressurized air will normally be used for the control of the cylinders 10' and 10".

Guide rollers 13 and 14 are rigidly mounted in the machine frame. Carriages are not required for the guide rollers. Guide rollers 13 and 13*a* guide the web 2. Guide rollers 14 and 14*a* guide the web 4. The guide rollers are so arranged relative to the carriers 11 that the respective web must pass through the gap between the heads 5 and 6. The two rollers 13 and 14 which are mounted in a stationary position but are rotatable, are spaced from one another by a spacing 27 shown in FIG. 2 just sufficiently for providing enough space for a severing knife 15 mounted on a knife head 16 for severing the respective end portion of a web that may extend upstream of a formed joint. A piston cylinder device or push rod 17 is provided for the back and forth movement of the severing knife 15. A brake mechanism 19 operated by rapid action piston cylinder devices 18 is arranged between the guide rollers 13 and 13*a* on the one hand, and between the guide rollers 14 and 14*a* on the other hand. Each brake mechanism 19 includes the required brake pads 19*a* for each material web 2, 4 to properly hold the webs 2 and 4 during the joining or splicing.

For securing the respective leading end 3 to the corresponding holding and press-on head 5 or 6, suction air is employed. For this purpose each of the heads 5, 6 is equipped with suction bores 20 connecting suction openings 20*a* to a suction bore 20*b* which in turn is connected to a suction source not shown. The suction openings 20*a* are provided in the press-on surface 5*a*, 6*a* respectively. The suction applied at the suction openings 20*a* is conventionally controlled in a precise and exactly defined manner by respective control valves not shown.

Figure 2:
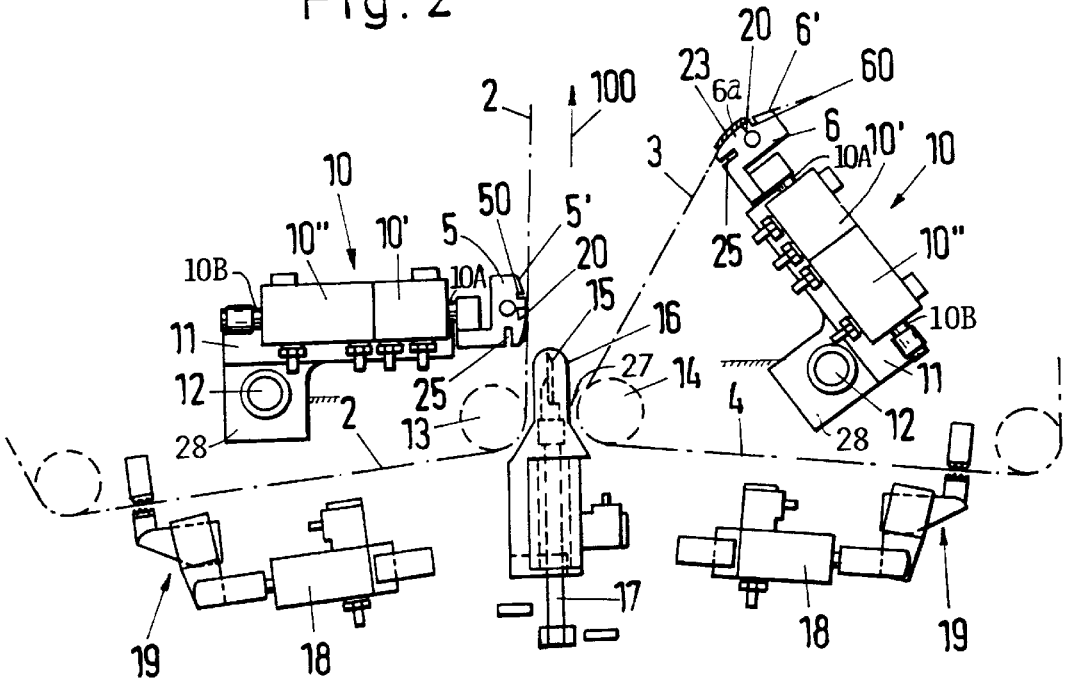
FIGS. 2 to 7 illustrate, on an enlarged scale, views similar to that of FIG. 1, however, omitting the web supply rollers and showing the sequential positions of the active components relative to each other in performing the method steps according to the invention.

The operation of the present apparatus will now be described, whereby it is assumed that the supply reel 7 is almost empty and that the leading end of the web 4 coming from the full supply reel 7*a* is to be spliced or joined to the trailing end 2' of the web or tape 2. First, the right-hand carrier 11 with its head 6 is manually tilted clockwise into the position shown in FIG. 2. Next, the leading end 3 of the web 4 is pulled off the supply reel 7*a* sufficiently so as to pass around the stationary guide roller 14 through the gap 27 between the guide roller 14 and the cutting head 16. The leading end 3 is then secured in a precise position to the press-on surface 6*a* of the head 6 with the aid of a positioning and locating scale 6' which permits aligning the leading end 3 precisely relative to the surface of the head 6*a*. When the leading end 3 is in a proper position, suction air through the bores 20 is switched on to properly hold the leading end in a located position. If the leading edge of the leading end 3 of the web 4 should project beyond a cutting groove 60 in the head 6, the operator can slice off the protruding tape end by passing a cutting edge through the groove 60. A similar cutting groove 50 is provided in the head 5 as best seen in FIGS. 2 and 9. The just described operations are performed manually by an operator.

Figure 3:
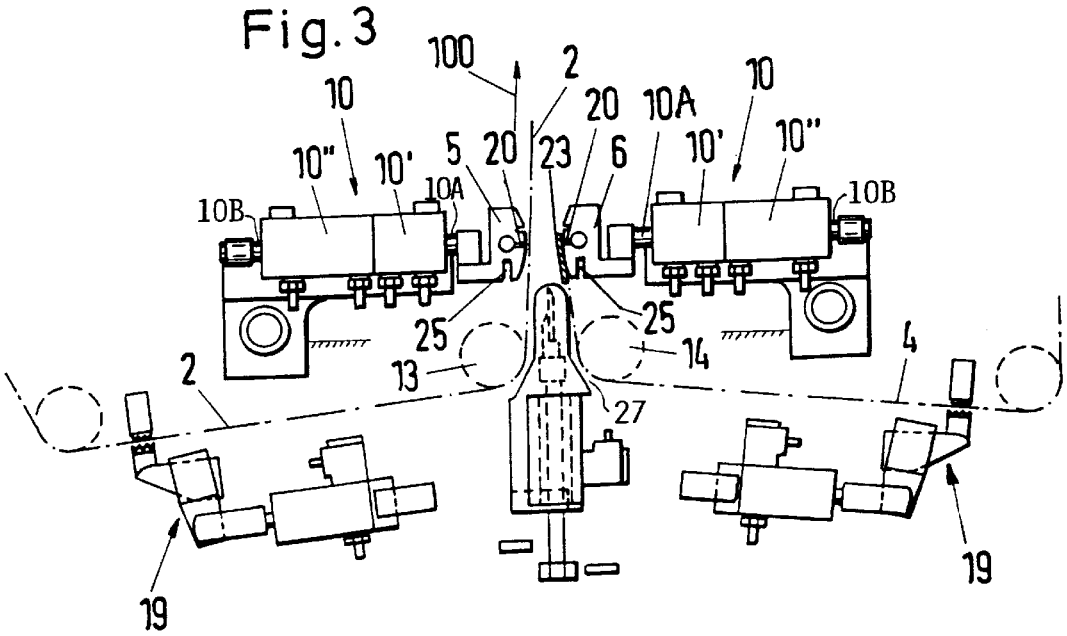

Once the leading end 3 is properly secured to the surface 6*a* of the head 6, and any protruding end portion has been severed, a piece of adhesive tape 23 that is adhesive on both surfaces, is applied to the leading end 3 in a precise position on the press-on surface 6*a* of the head 6. Next, the right-hand support 11 is tilted with its head 6 counterclockwise into the starting position as shown in FIG. 3. Any slack caused by this return tilt of the head 3 in the tape 4 is taken up by slightly rotating the supply reel 7*a* counterclockwise until the tape 4 is taut again.

Next, the piston cylinder device 10' is activated so that its piston rod 10*a* moves the head 6 slightly to the left into its press-on position. Please note that the piston rod 10*a* is extending out of its cylinder 10' more in FIG. 3 than in FIG. 2. The extension of the piston rod is relatively small and within the range of about 5 mm to assume the position shown in FIG. 3.

Figure 4:
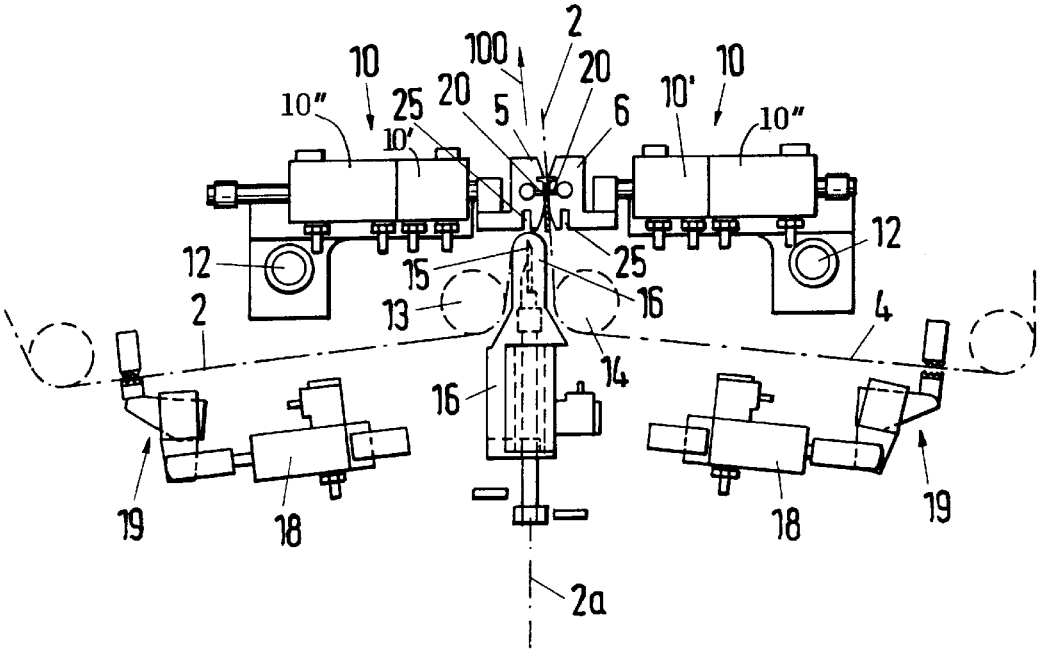

Next, the material web or tape 3 passing around the stationary guide roller 13 is stopped by activating the left-hand tape braking mechanism 19 as shown in FIG. 4. In order not to interrupt the operation of a machine that uses the web or tape, the storage station 9 shown in FIG. 1 will keep supplying the tape to the using machine during the standstill. The storage station 9 shown in FIG. 1 has a sufficient storage capacity for this purpose, for example, by permitting the rollers 9*a* to move closer to the rollers 9*b*. Such storage stations 9 as shown in FIG. 1 are conventional. The machine using the tape or web 2 or 4 is not shown in FIG. 1.

Next, both piston cylinder devices 10' and 10" on the left-hand carrier 11 in FIG. 3 are activated so that the head 5 is moved from the position shown in FIG. 3 into that of FIG. 4 which shows the press-on position where the two heads 5 and 6 are pressed against each other. As a result of the rightward movement of the head 5, the material web is stretched around the upper end of the cutting head 16 and the cutting knife 15 becomes aligned with the cutting groove 25. Thus, the tape 2 runs from the stationary guide roller 13 in a curve around the free end of the knife head 16, around the press-on surface of the head 5 and toward the inlet guide roller 9' of the storage station 9.

Figure 5:
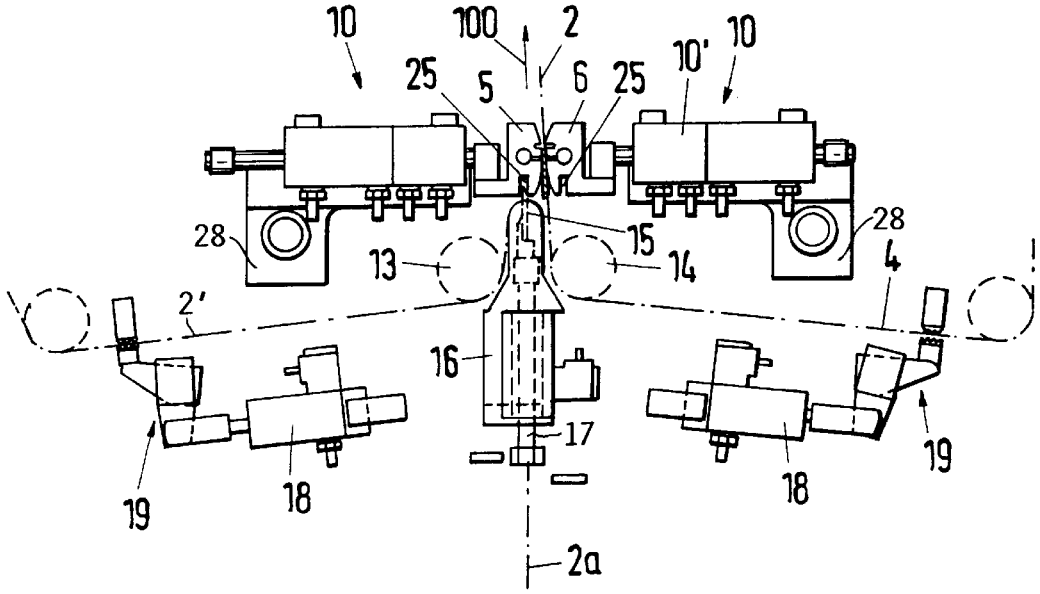
Figure 6:
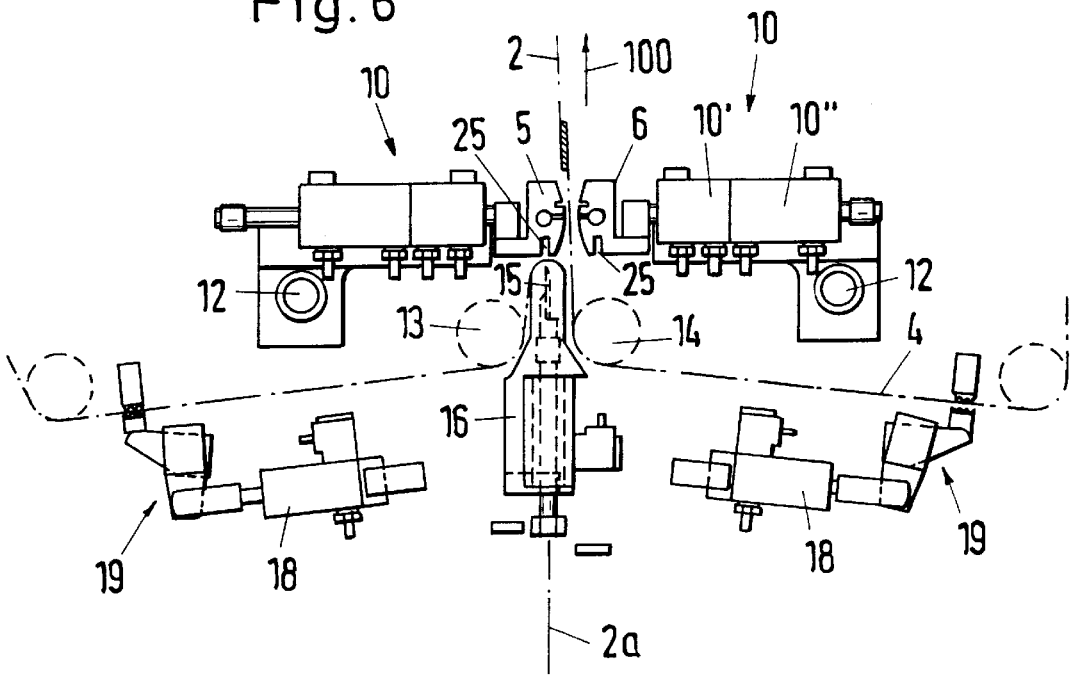

Once the just described orientation of the tape 2 has been achieved as shown in FIG. 4, the severing knife 15 is operated by the drive or push rod 17 to move into the cutting groove 25 and sever the trailing end 2' off the tape 2 as shown in FIG. 5. As soon as the web or tape 2 is severed, the suction in the head 6 is switched off so that the material web, or rather the splice that has been formed, is released from the press-on surface 6*a* of the head 6. Simultaneously, the head 6 is pulled back by the activation of its cylinder 10' of the piston cylinder device 10. As a result, the splice with its adhesive tape 23 is released from the head 6 and assumes the position shown in FIG. 6. The tape can also lift off the surface of the head 5, because no suction is applied to the head 5 at this time. The lift off is also made possible by the position of the two stationary guide rollers 13 and 14 which make sure that the tape is guided in the direction of the arrow 100 toward the inlet guide roller 9' of the storage station 9. For this purpose the two guide rollers 13 and 14 are arranged mirror-symmetrically to the central vertical plane 2*a*. The knife 15 is also located in this central plane and so is the cutting groove 25 when the respective head is in the effective holding and press-on position. As mentioned, the central plane 2*a* extends tangentially to the inlet guide roller 9'. The three guide rollers 9', 13, and 14 form an acute triangle, the acute angle of which points in the travel direction 100 of the web 2 or 4, whereby the central plane 2*a* bisects the acute angle of the triangle. The fixed journal axes 12 of the two carriers 11 are so positioned relative to the rotational axis of the guide rollers 13 and 14 that the facing surfaces 5*a* and 6*a* of the heads 5 and 6 move respectively to the right or to the left beyond the central plane 2*a* as may be seen in FIGS. 4, 5, and 6. Additionally, FIG. 6 shows that both heads 5 and 6 are slightly spaced from the travel direction of the tape, namely away from a tangential line to both rollers 9' and 14 or 9' and 13 as the case may be. Thus, during normal operation the heads 5 and 6 do not contact the web or tape.

Figure 7:
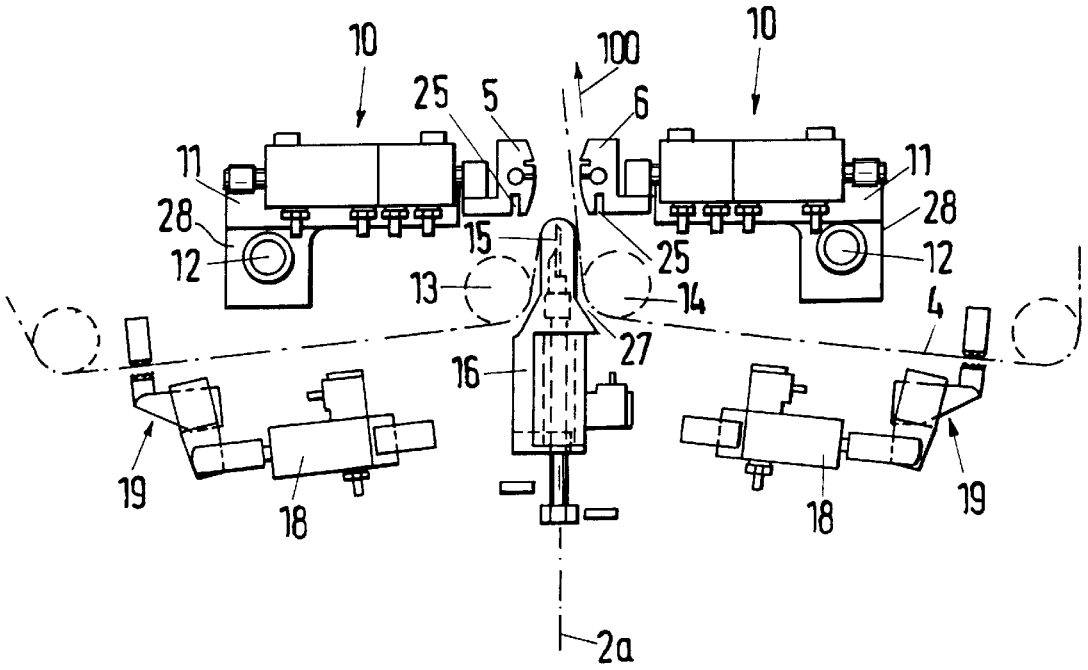

Once the head 6 has moved a small distance to the right in order to release the splice or joint formed by the adhesive tape 23, the severing knife 15 is also pulled back into the cutting head 16 by a respective operation of the rod 17. The holding and press-on head 5 also moves back into its starting position as shown in FIG. 7 and the left-hand brake mechanism 19 is released again as shown in FIG. 7. The storage station 9 is now refilled with the material web 4 reeling off the supply reel 7*a* shown in FIG. 1.

With the exception of the cutting knife 15 with the cutting head 16, the present apparatus comprises all components in pairs, such as two reel support backs 8 for two supply reels 7, 7*a*, and all the other components shown in pairs in FIGS. 1 to 8. The members of a pair are arranged in mirror-symmetrical positions relative to the central plane 2*a*. The two journal axes 12 for the carriers 11 of the heads 5 and 6 are arranged with a spacing from the rotational axes of the stationary guide rollers 13 and 14. In other words, relative to the central plane 2*a*, the journal axes 12 are located outwardly of the knife head 16 while the latter is located in the spacing 27 between the guide rollers 13 and 14. A plane passing through both journal axes 12 is located slightly above a plane passing through both rotational axes of the guide rollers 13 and 14.

Figure 8:
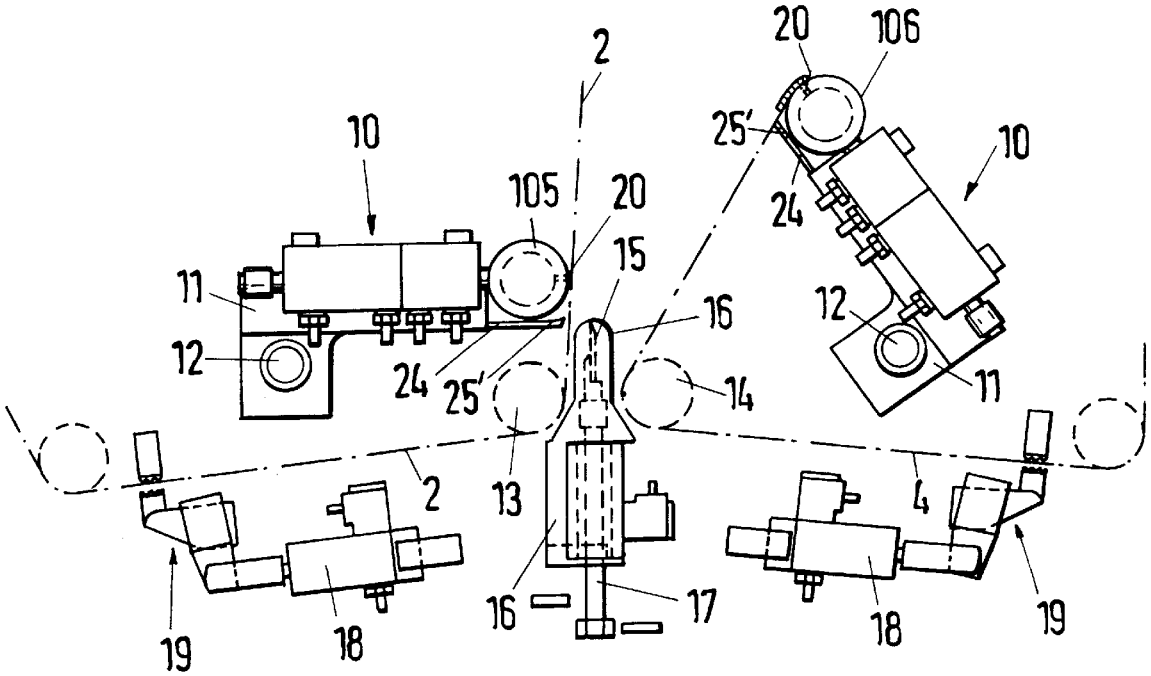
FIG. 8 is a view similar to that of FIG. 2, however, showing a different construction of a holding and press-on head.

FIG. 8 shows modified holding and press-on heads 105, 106 which have a substantially circular cross-section. The cutting groove 25' is not located in the head, but rather in a cutting plate 24 below the circular head 105, 106. Otherwise, the function and operation of the circular holding end press-on heads 105, 106 is the same as described above.

The apparatus according to the invention can also use an adhesive tape which is only tacky on one side instead of the double-sided adhesive tape 23. When a one-sided adhesive tape is used, the two web or tape ends abut each other rather than overlapping each other. The above described operational steps are substantially the same for a one-sided adhesive tape as for a double-sided adhesive tape. The one-sided adhesive tape must also be precisely located on the respective holding and press-on head 5, 6, 105, or 106, whereby again vacuum is applied for holding the tape in place. The leading tape end is attached to the one-sided adhesive tape so that only half of the tacky surface is covered by the leading edge of the new tape 4 to leave enough tape for securing the trailing edge of the running out tape.

The two carriers 11 with their heads 5, 6 or 105, 106 are so arranged that the longitudinal axis of the respective piston cylinder device 10 extends substantially perpendicularly to the central plane 2*a* and so that the carriers are tiltable about the journal axis 12 substantially in the travel direction of the material webs 2, 4 away from the cutting knife 15. That is, the right-hand carrier 11 is tilted clockwise into the joining position while the left-hand carrier 11 is tilted counterclockwise and vice versa. When one of the heads is tilted into the inoperative upper position there is easy access for the insertion of the leading end of a new material web which can be simply replaced. Similarly, there is easy access for maintenance work.

By using two cylinders 10', 10" with their respective piston rods 10*a* and 10*b* in each of the piston cylinder devices 10 as shown in FIG. 9, it is possible to provide different strokes for each piston rod 10*a* and 10*b*. This feature of the invention permits an operation mode in which the respective head 5, 6, or 105, 106 can be advanced and withdrawn in a stepwise manner. Especially the withdrawal movement after the adhesive splice has been formed takes place abruptly by only a few millimeters so that the material webs 2, 4 are rapidly released from the respective holding and press-on head 5, 6 or 105, 106. The very short stroke of, for example, only 5 mm is sufficient when the geometric position of the guide rollers 13 and 14 relative to one another and relative to the inlet guide roller 9' of the storage station 9 is selected as described with reference to the present example embodiment so that the movement directions of the webs 2 and 4 from the surface of the guide roller 13 to the surface of the guide roller 9' and from the surface of the guide roller 14 to the guide roller 9' enclose an acute angle as mentioned above. As a result, only a very short time duration is needed for releasing the spliced material webs while, on the other hand, there is sufficient time for the cutting knife 15 to be pulled out of the cutting groove 25 and for returning the respective carrier with its holding and press-on head into the starting position. As a result, the steps needed for the formation of the splice and the operation of the apparatus for splicing the material web ends is thus simple, safe, and reliable.

Although the invention has been described with reference to specific example embodiments it will be appreciated that it is intended to cover all modifications and equivalents within the scope of the appended claims.

What I claim is:

1. An apparatus for joining ends of material webs to each other to form a splice by adhesive means, comprising a machine frame, at least two guide rollers (13, 14) rotatably mounted to said machine frame in fixed positions symmetrically relative to each other and relative to a plane of symmetry **(2*a*) passing through a gap (27) between said two guide rollers, two tiltable carriers (11), two web holding and press-on means (5, 6), linear drive means (10) separately mounting each of said holding and press-on means on a respective carrier (11) of said two tiltable carriers, two journal shafts (12) mounted in said machine frame for journalling said carriers (11) for a rotational tilting movement of each carrier (11) with its respective web holding and press-on means (5, 6), whereby said holding and press-on means are movable angularly and linearly, said two journal shafts (12) being arranged symmetrically relative to said plane of symmetry (2*a*) and with a spacing from the respective guide roller(13, 14) outside said gap (27) between said guide rollers (13, 14), said spacing being sufficient for permitting said tilting movement, suction means as part of said holding and press-on means for holding a web end in place, each of said linear drive means comprising two separately operable piston cylinder devices, each including a piston rod and a cylinder connected back to back with the respective other cylinder, so that one piston rod carries the respective holding and press-on means while the other piston rod is connected to the respective tiltable carrier (11), for individually and linearly moving each of said holding and press-on means (5, 6) on its respective tiltable carrier (11) in a stepwise manner and in a direction crossing said plane of symmetry (2*a*) toward each other for applying pressure to a splice being formed and for moving said holding and press-on means (5, 6) away from each other out of contact with a web, and cutting means (16) comprising a single blade (15) operatively mounted for operation in said gap (27)**.

2. An apparatus for joining ends of material webs to each other to form a splice by an adhesive, comprising a machine frame, at least two guide rollers (13, 14) rotatably mounted to said machine frame in fixed positions symmetrically relative to a plane of symmetry **(2*a*) passing through a gap (27) between said two guide rollers, two journal shafts (12) mounted in said machine frame on opposite sides of said guide rollers (13, 14) and on opposite sides of said plane of symmetry (2*a*), two carriers (11) mounted on said journal shafts (12) tiltable independent of each other, two web holding and press-on heads (5, 6) each mounted to its independently tiltable carrier, separate linear drives (10) for separately stepping each of said holding and press-on heads on its respective carrier (11) with linear stepwise strokes crossing said plane of symmetry, said journal shafts permitting tilting each of said carriers (11) and its holding and press-on head into an out of the way position for access to both holding and press-on heads (5, 6), said two journal shafts (12) being arranged symmetrically relative to said plane of symmetry (2*a*) and with a spacing from each other so that in an operative non-tilted position said holding and press-on heads (5, 6) face each other directly across said plane of symmetry (2*a*) with a minimal spacing between each other sufficient for permitting a tilting movement and for reducing said stepwise strokes to a minimum, a suction source cooperating with said holding and press-on heads for holding a web end in place, said linear drives (10) being adapted for separately and linearly moving said holding and press-on heads (5, 6) on its respective tiltable carrier (11) with different forward and backward stepwise strokes crossing said plane of symmetry (2*a*) toward each other for applying pressure to a splice being formed and away from each other for moving said holding and press-on heads (5, 6) out of contact with a web for a web release, and a cutting knife (16) comprising a single blade (15) operatively mounted for operation in said plane of symmetry (2*a*), each of said holding and press-on heads comprising a counterholder (25) so positioned on the respective holder and press-on head that said counterholder is in said plane of symmetry (2*a*) for cooperation with said single blade (15) when the respective holding and press-on head crosses said plane of symmetry (2*a*), said apparatus further comprising a web brake (18, 19)** for individually and temporarily stopping each of said material webs during a joining operation.

3. The apparatus of claim 2, wherein each of said holding and press-on heads (5, 6) is individually tiltable away from said guide rollers and back toward said guide rollers.

4. The apparatus of claim 2, wherein each of said linear drives (10) comprises a piston cylinder device (10) for applying said stepwise strokes to the respective holding and press-on head (5, 6), and wherein each of said carriers (11) has a rear end (28) away from the respective holding and press-on head, each of said journal shafts (12) passing through the respective carrier rear end away from facing ends of said holding and press-on heads (5, 6).

5. The apparatus of claim 4, wherein each of said linear drive piston cylinder devices (10) comprises two separately operable piston cylinders each having its own piston rod, whereby one piston cylinder device performs one step of said stepwise stroke and the other piston cylinder device performs a further step of said stepwise stroke.

6. The apparatus of claim 5, wherein said two separately operable piston cylinder devices are connected to each other back-to-back so that one piston rod carries the respective holding and press-on head while the other piston rod is connected to the respective tiltable carrier (11).

7. The apparatus of claim 2, wherein each of said web brakes (19) for each material web comprises a rapid action piston cylinder drive for operating each web brake.

8. The apparatus of claim 2, wherein each of said guide rollers (13, 14) is arranged on its side of said plane of symmetry (2A) passing vertically through said gap (27) formed between facing surfaces of said holding and press-on heads, wherein a further guide roller (9') is arranged downstream of said holding and press-on heads, as viewed in a travel direction of said webs, in a position so that said plane of symmetry extends tangentially to said further guide roller (9'), and wherein runs of said material webs from said stationary guide rollers (13, 14) to said further guide roller (9') form an acute angle, said plane of symmetry bisecting said acute angle.

9. The apparatus of claim 2, wherein said single cutting blade (15) is arranged between said guide rollers (13, 14), and wherein said holding and press-on heads are in a working position close to said guide rollers (13, 14) when said carriers (13) are in a tilted-in position forming said working position.

10. A method for joining ends of material webs to each other to form a splice by adhesive means with two tiltably mounted holding and press-on heads, comprising the following steps:

(a) first tilting one of said holding and press-on head in a rotational movement out of an operating position into an out of the way position to provide access to said holding and press-on heads, (b) pulling a leading end of a new web around a guide roller, (c) securing said leading web end to said one holding and press-on head in said out of the way position, (d) applying an adhesive to said leading web end, (e) second tilting said one holding and press-on head rotationally back into said operating position in which both press-on heads face each other with minimal spacing across a plane of symmetry (2*a*) extending centrally between said press-on heads in their operating position, (f) imparting a first linear forward stroke to one of said holding and press-on heads for pressing adhesive means against said leading web end and against a trailing web end of a running out material web held in place by the holding and press-on head by pressing said two holding and press-on heads against each other outside said plane of symmetry to perform said joining, (g) imparting a second linear forward stroke movement for moving at least one of said two holding and press-on heads into a position for cutting any excess end portion of said trailing web end, (h) cutting said excess end portion of said trailing web end in said central plane of symmetry, (i) applying a brake action at least to said running out material web at least during said joining, without braking a rotation of web supply reels, and (j) and linearly moving at least one of said two holding and press-on heads in a backward stroke away from the other holding and press-on head for a release of a spliced web, whereby said two holding and press-on heads perform different strokes for advancing toward each other and for withdrawal from each other.

11. The method of claim 10, wherein said leading web end, in said step of securing is attached to a surface of said first holding and press-on head in a precisely defined position by applying suction to said leading web end and by using a measuring scale for a lateral alignment of said leading web end with said trailing web end.

12. The method of claim 10, further comprising pulling a length of new material web downstream beyond the respective holding and press-on head for a precise locating of the leading material web end on the respective holding and press-on head.

13. The method of claim 10, wherein said cutting of said excess end portion of said trailing web end is performed along a groove in the respective holding and press-on head, when said groove is positioned in said plane of symmetry.

14. The method of claim 10, wherein said applying of said adhesive comprises using a double faced adhesive tape applied to the leading web end, and wherein the respective holding and press-on head is then tilted back into said operating position next to said guide roller.

15. The method of claim 10, wherein said pressing of adhesive involves moving said one holding and press-on head to which the leading web end has been secured, into a press-on position following said second tilting movement back into said operating position.

16. The method of claim 10, further comprising positioning said two holding and press-on heads in such a press-on position that respective press-on surfaces are in a running plane of the respective material web, slightly beyond said plane of symmetry.

17. The method of claim 10, further comprising moving said other holding and press-on head into contact with a press-on surface of one holding and press-on head for joining two web ends to each other, whereby said other holding and press-on head passes through said plane of symmetry.

18. The method of claim 10, further comprising moving said other holding and press-on head which does not carry the leading web end of the new web for the press-on operation toward said one holding and press-on head which has secured thereto said leading web end.

19. The method of claim 10, further comprising holding a respective web end by suction and releasing said web end from the respective holding and press-on head by switching off the suction, and wherein said holding and press-on head carrying the leading web end is moved back into its starting position by means of a stepwise operating piston cylinder device.

20. The method of claim 10, wherein following said cutting in said plane of symmetry a severing knife is withdrawn into its starting position also in said plane of symmetry within a knife head, and wherein said other holding and press-on head is also returned into its starting position.

* * * * *

UNITED STATES PATENT AND TRADEMARK OFFICE

CERTIFICATE OF CORRECTION

PATENT NO. : 6,013,148

DATED : January 11, 2000

INVENTOR(S) : Martin Bluemle

It is certified that error appears in the above-identified patent and that said Letters Patent is hereby corrected as shown below:

Title Page: under "References Cited US PATENT DOCUMENTS", following line 1, insert --4,010,911 03/1977 Heitmann
4,374,576 02/1983 Ryan--;

Signed and Sealed this

Nineteenth Day of September, 2000

*Attest:*

Q. TODD DICKINSON

*Attesting Officer*

*Director of Patents and Trademarks*